US006216299B1

(12) United States Patent
Kohlman

(10) Patent No.: US 6,216,299 B1
(45) Date of Patent: Apr. 17, 2001

(54) WHEELCHAIR CUSHION SYSTEM

(76) Inventor: Steven Kohlman, 206- 1st Ave. NE., Clarks Grove, MN (US) 56016

( * ) Notice: Subject to any disclaimer, the term of this patent is extended or adjusted under 35 U.S.C. 154(b) by 0 days.

(21) Appl. No.: 09/532,386

(22) Filed: Mar. 22, 2000

Related U.S. Application Data

(63) Continuation-in-part of application No. 09/371,152, filed on Aug. 9, 1999.

(51) Int. Cl.[7] ..... A47C 27/10; A61G 7/057
(52) U.S. Cl. ..... 5/654; 5/713; 5/714
(58) Field of Search ..... 5/654, 713, 710, 5/714; 297/284.3, 284.6

(56) References Cited

U.S. PATENT DOCUMENTS

| | | | | |
|---|---|---|---|---|
| 2,998,817 | * | 9/1961 | Armstrong | 5/713 |
| 3,148,391 | * | 9/1964 | Whitney | 5/713 |
| 4,175,297 | * | 11/1979 | Robbins et al. | 5/713 |
| 5,103,518 | * | 4/1992 | Gilroy et al. | 5/713 |
| 5,109,560 | * | 5/1992 | Uetake | 5/713 |
| 5,500,965 | * | 3/1996 | Hanagan et al. | 5/654 |
| 5,701,622 | * | 12/1997 | Biggie et al. | 5/710 |
| 5,963,997 | * | 10/1999 | Hagopian | 5/654 |
| 6,014,784 | * | 1/2000 | Taylor et al. | 5/710 |

* cited by examiner

*Primary Examiner*—Alexander Grosz
(74) *Attorney, Agent, or Firm*—Michael S. Neustel

(57) ABSTRACT

A wheelchair cushion system for alternating the pressure points upon the individual's body and providing adequate ventilation to the individual's body in contact with the cushion thereby significantly reducing pressure sores. The inventive device includes a battery, a power switch electrically connected to the battery, a pump timer electrically connected to the power switch and to a pump, a first cycle timer electrically connected to the power switch and a first valve wherein the first valve is fluidly connected to the pump, a second cycle timer electrically connected to the power switch and a second valve wherein the second valve is fluidly connected to the pump, a plurality of first pockets fluidly connected to said first valve, and a plurality of second pockets fluidly connected to the second valve. The first valve and the second valve each include a discharge port that are fluidly connected to a first return tube and a second return tube respectively that are positioned within the pockets to provide ventilation within the cushion. The first pockets and the second pockets are connected to a base and are preferably are surrounded by a removable cover. The first pockets are positioned upon the base so that they form alternating channels of support with respect to the second pockets. The user can control the amount of fluid pressure within the pockets by adjusting the pump timer which controls the duration of operation of the pump. The user can control the amount of time that the first pockets and the second pockets are inflated by adjusting the first cycle timer and second cycle timer respectively. A check valve is preferably fluidly positioned between the pump and the first valve and second valve. In an alternative embodiment, a pressure switch is positioned upon the invention that detects when an individual sits upon the invention thereby automatically operating the invention.

16 Claims, 4 Drawing Sheets

WHEELCHAIR CUSHION SYSTEM

CROSS REFERENCE TO RELATED PATENT APPLICATION

This application is a continuation-in-part from U.S. patent application Ser. No. 09/371,152 filed on Aug. 9, 1999. The 09/371,152 application is still pending within the U.S. Patent & Trademark Office.

BACKGROUND OF THE INVENTION

1. Field of the Invention

The present invention relates generally to cushion devices for individuals confined to a wheel chair of bed for extended periods of time and more specifically it relates to a wheelchair cushion system for alternating the pressure points upon the individual's body and providing adequate ventilation to the individual's body in contact with the cushion thereby significantly reducing pressure sores.

Individuals that are confined to a bed or wheelchair often times develop decubitus ulcers also known as pressure sores because of prolong periods of exposure to excessive pressure and excessive moist conditions to certain portions of the body. Conventional methods of relieving said excessive pressures include changing the posture of lying or sitting, thereby moving the high pressure points that cause pressure sores.

Unfortunately, many individuals are unable to lift or move themselves due to physical ailment or other reasons thereby requiring an assistant to lift or move them. For individuals capable of lifting or moving their bodies into different positions, sometimes they forget to lift or move their bodies resulting in pressure sores. Various solutions have been proposed such as vibrating or massaging means attached to the bed. However, none of the prior art solutions have been widely utilized because of the cost or ineffectiveness in reducing pressure sores. Hence, there is a need for an invention that effectively reduces pressure sores for a wheelchair or bed confined individual at an affordable cost for most consumers and businesses.

2. Description of the Prior Art

Various cushion devices have been attempted over the years. Examples of cushion devices include U.S. Pat. No. 4,799,276 to Kadish; U.S. Pat. No. 5,005,240 to Vrzalik; U.S. Pat. No. 5,509,155 to Zigarac et al; U.S. Pat. No. 5,687,438 to Biggie et al; U.S. Pat. No. 5,243,721 to Teasdale; U.S. Pat. No. 5,216,768 to Bodine et al; U.S. Pat. No. 4,953,247 to Hasty; U.S. Pat. No. 5,267,364 to Volk; U.S. Pat. No. 5,564,142 to Liu; U.S. Pat. No. 5,115,527 to Medley; U.S. Pat. No. 3,867,732 to Morrell; U.S. Pat. No. 4,190,286 to Bentley; U.S. Pat. No. 4,070,719 to Morgan; U.S. Pat. No. 4,688,285 to Roberts; U.S. Pat. No 5,025,519 to Spann et al; U.S. Pat. No. 5,463,785 to McKeel; U.S. Pat. No. 5,640,728 to Graebe; U.S. Pat. No. 3,885,257 to Rogers which are all illustrative of such prior art.

Kadish (U.S. Pat. No. 4,799,276) discloses a body rest with means for preventing pressure sores. Kadish teaches a matrix of vertical displaceable supports that are basically air-supported pistons. Kadish teaches measuring the pressure exerted by the individual's body upon the pistons and further teaches valves controlling the discharge of air from the piston chambers. Kadish further teaches all pistons being brought back to their initial common high level.

Vrzalik (U.S. Pat. No. 5,005,240) discloses a patient support apparatus. Vrzalik teaches sets of air bag mounted with the frame of bed. Individually controlled valves are used to adjust the amount of air which flows to the gas manifolds and on into the air bags of Vrzalik.

Zigarac et al (U.S. Pat. No. 5,509,155) discloses an alternating low air loss pressure overlay for patient bedside chair. Zigarac et al teaches a plurality of horizontally aligned pressure sacs that are in contact with the seated patient.

Biggie et al (U.S. Pat. No. 5,687,438) discloses an alternating low air loss pressure overlay for patient bedside chair and mobile wheel chair. Biggie et al teaches a plurality of horizontal aligned pressure sacs that are in contact with the seated patient similar to Zigarac et al.

While these devices may be suitable for the particular purpose to which they address, they are not as suitable for alternating the pressure points upon the individual's body and providing adequate ventilation to the individual's body in contact with the cushion thereby significantly reducing pressure sores. Previous attempts to reduce pressure sores to individuals confined to a wheelchair or bed have been either ineffective in reducing bedsores, are to costly, or are not easy to utilize over extended periods of time.

In these respects, the wheelchair cushion system according to the present invention substantially departs from the conventional concepts and designs of the prior art, and in so doing provides an apparatus primarily developed for the purpose of alternating the pressure points upon the individual's body and providing adequate ventilation to the individual's body in contact with the cushion thereby significantly reducing pressure sores.

SUMMARY OF THE INVENTION

In view of the foregoing disadvantages inherent in the known types of cushion devices for beds and wheelchairs now present in the prior art, the present invention provides a new wheelchair cushion system construction wherein the same can be utilized for alternating the pressure points upon the individual's body and providing adequate ventilation to the individual's body in contact with the cushion thereby significantly reducing pressure sores.

The general purpose of the present invention, which will be described subsequently in greater detail, is to provide a new wheelchair cushion system that has many of the advantages of the known wheelchair and bed cushions mentioned heretofore and many novel features that result in a new wheelchair cushion system which is not anticipated, rendered obvious, suggested, or even implied by any of the prior art cushions, either alone or in any combination thereof.

To attain this, the present invention generally comprises a battery, a power switch electrically connected to the battery, a pump timer electrically connected to the power switch and to a pump, a first cycle timer electrically connected to the power switch and a first valve wherein the first valve is fluidly connected to the pump, a second cycle timer electrically connected to the power switch and a second valve wherein the second valve is fluidly connected to the pump, a plurality of first pockets fluidly connected to said first valve, and a plurality of second pockets fluidly connected to the second valve. The first pockets and the second pockets are connected to a base and are preferably are surrounded by a removable cover. The first pockets are positioned upon the base so that they form alternating channels of support with respect to the second pockets. The user can control the amount of fluid pressure within the pockets by adjusting the pump timer which controls the duration of operation of the pump. The user can control the amount of time that the first pockets and the second pockets are inflated by adjusting the first cycle timer and second cycle timer respectively. A check valve is preferably fluidly positioned between the pump and the first valve and second valve. In an alternative embodiment, a pressure switch is positioned upon the invention that detects when an individual sits upon the invention thereby automatically operating the invention.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a wheelchair cushion system that will overcome the shortcomings of the prior art devices.

The main object of the present invention is to provide a wheelchair cushion system that alternates the pressure points upon the individual's body and provides adequate ventilation to the individual's body in contact with the cushion thereby significantly reducing pressure sores.

Another object is to provide a wheelchair cushion system that effectively reduces pressure sores to a bed or wheelchair confined individual.

A further object is to provide a wheelchair cushion system that provides adequate ventilation to areas of the individual's body that are in contact with the cushion.

Another object is to provide a wheelchair cushion system that reduces moist conditions adjacent the individual's body and maintains the individual's body in a dry condition.

An additional object is to provide a wheelchair cushion system that alternates the pressure points upon an individual based upon user selected timed intervals.

A further object is to provide a wheelchair cushion system that is portable and can be utilized in various locations.

Another object is to provide a wheelchair cushion system that is of a structure that can be manufactured and sold at an affordable cost.

Another object is to provide a wheelchair cushion system that relieves excessive local pressure to which a patient is subjected to over a prolonged period of time.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
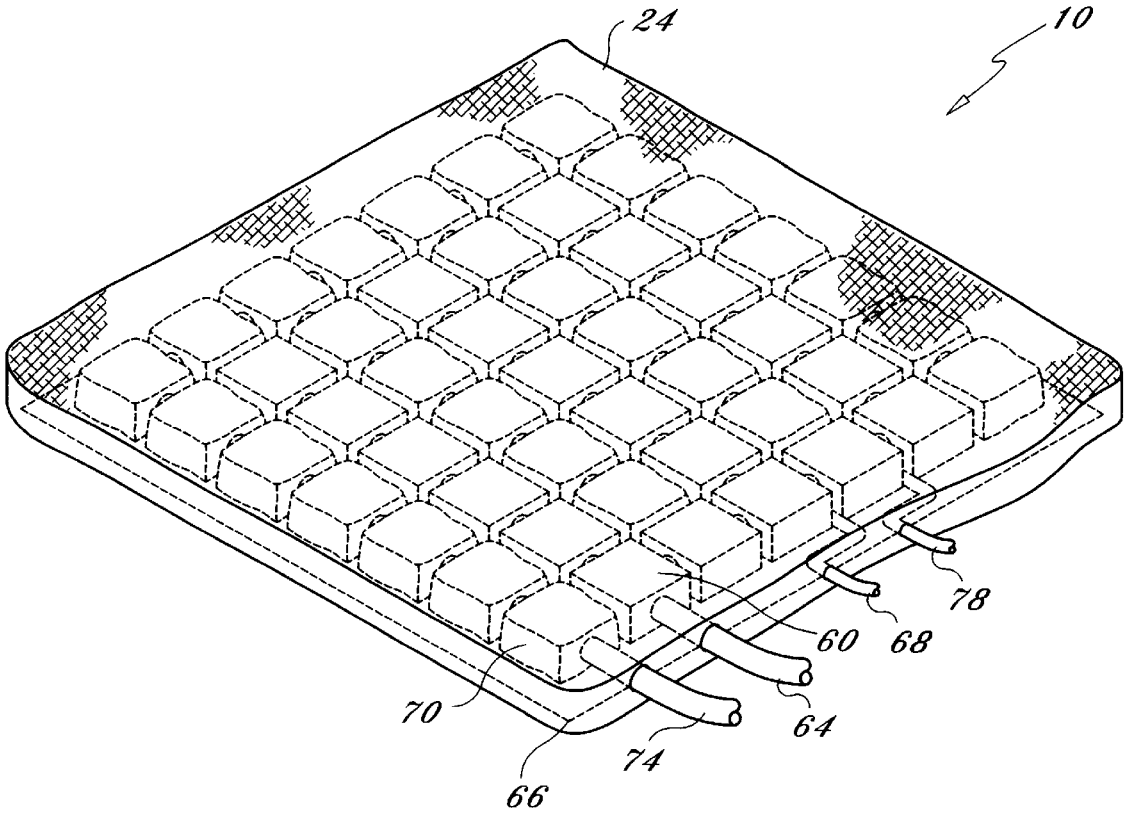
FIG. 1 is an upper perspective view of the present invention.

Turning now descriptively to the drawings, in which similar reference characters denote similar elements throughout the several view, FIGS. 1 through 5 illustrate a wheelchair cushion system 10, which comprises a battery 36, a power switch 22 electrically connected to the battery 36, a pump timer 40 electrically connected to the power switch 22 and to an air pump 30, a first cycle timer 42 electrically connected to the power switch 22 and a first valve 50 wherein the first valve 50 is fluidly connected to the air pump 30, a second cycle timer 44 electrically connected to the power switch 22 and a second valve 54 wherein the second valve 54 is fluidly connected to the air pump 30, a plurality of first pockets 60 fluidly connected to said first valve 50, and a plurality of second pockets 70 fluidly connected to the second valve 54. The first pockets 60 and the second pockets 70 are connected to a base 66 and are preferably are surrounded by a removable covering 24. The first pockets 60 are positioned upon the base 66 so that they form alternating channels of support with respect to the second pockets 70. The user can control the amount of fluid pressure within the pockets by adjusting the pump timer 40 which controls the duration of operation of the air pump 30. The user can control the amount of time that the first pockets 60 and the second pockets 70 are inflated by adjusting the first cycle timer 42 and second cycle timer 44 respectively. A check valve 32 is preferably fluidly positioned between the air pump 30 and the first valve 50 and second valve 54. In an alternative embodiment, a pressure switch is positioned upon the invention that detects when an individual sits upon the invention thereby automatically operating the invention.

Figure 4:
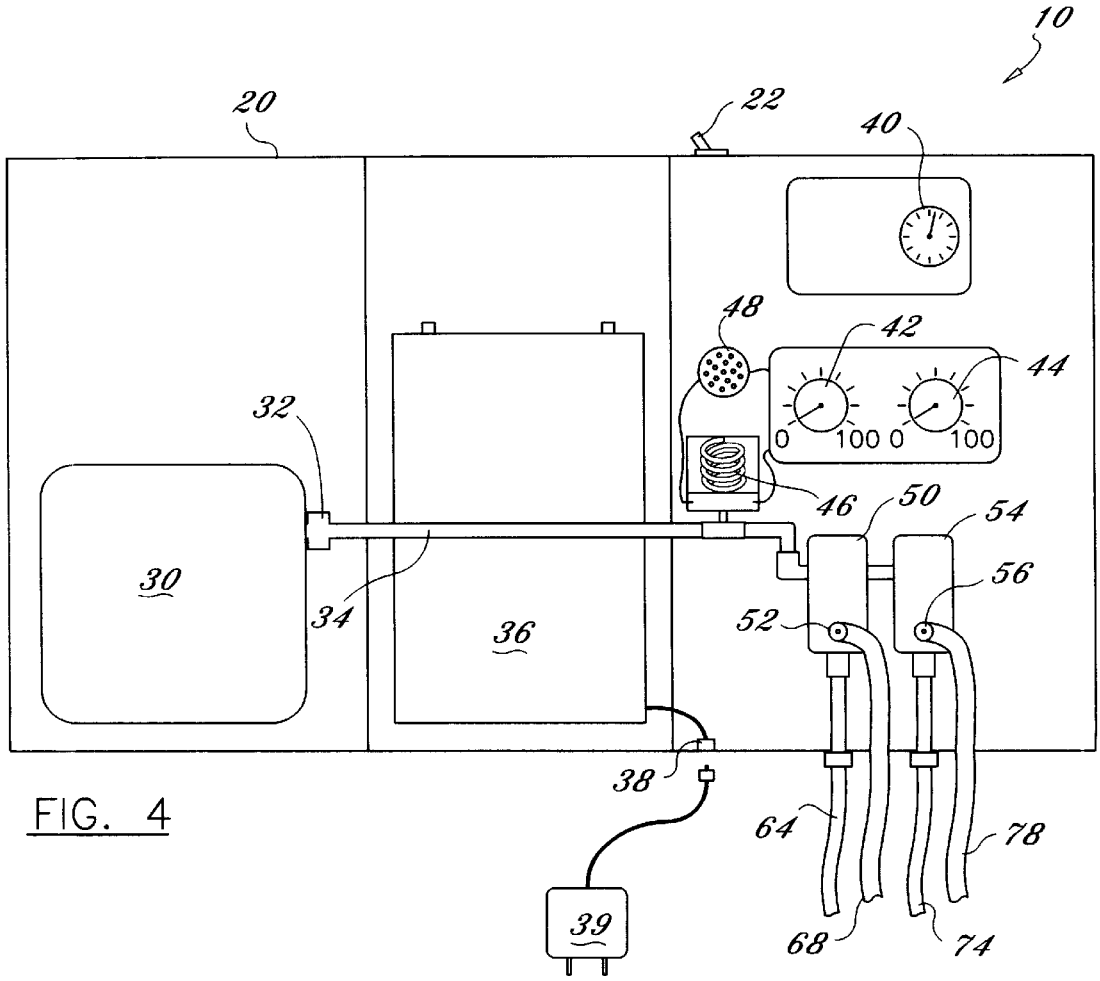
FIG. 4 is a top view of the control unit.

As shown in FIG. 4 of the drawings, a housing 20 supports and encloses all of the electrical devices within the present invention. A cover is preferably pivotally attached to the housing 20 for allowing selective enclosing of the control panel and switches within the housing 20. Although not shown in the drawings, a plurality of support straps are preferably attached to the housing 20 for selectively engaging and supporting the housing 20 to a wheelchair 12 or other structure.

As shown in FIG. 4 of the drawings, a battery 36 is positioned within the housing 20. A recharging socket 38 is positioned within the exterior of the housing 20 and is electrically connected to the battery 36 for receiving a recharging unit 39 thereby allowing recharging the battery 36 over a period of time as shown in FIG. 4 of the drawings.

Figure 5:
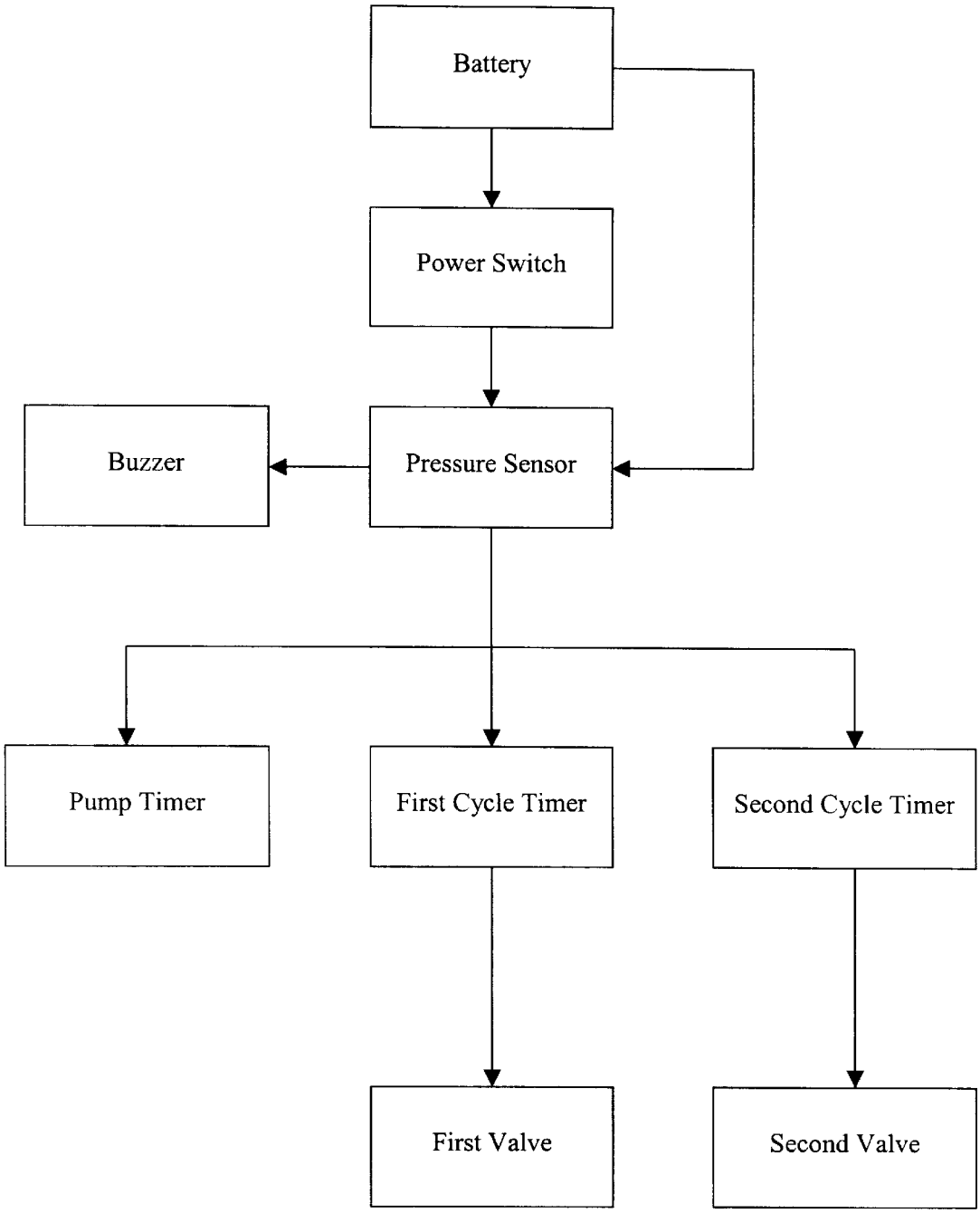
FIG. 5 is a block diagram illustrating the electrical circuitry of the present invention.

As shown in FIG. 4 of the drawings, the power switch 22 is positioned within the housing 20. The power switch 22 is electrically connected to the battery 36 as shown in FIG. 5 of the drawings. In the alternative embodiment, a pressure switch is electrically connected to the power switch 22 and to the battery 36 for automatically providing electrical power to the present invention when the user sits upon the invention. The pressure switch is preferably positioned within the base 66 or pockets 60, 70 of the present invention.

As shown in FIGS. 4 and 5 of the drawings, a pump timer 40 is positioned within the housing 20 and electrically connected to the power switch 22. The pump timer 40 is electrically connected to the air pump 30 for controlling the length of time that the air pump 30 is in operation thereby controlling the air pressure within the pockets 60, 70 as shown in FIG. 5 of the drawings. As shown in FIG. 4 of the drawings, the air pump 30 is preferably positioned within the housing 20.

As shown in FIG. 4 of the drawings, the air pump 30 is fluidly connected to the first valve 50 and the second valve 54 by a main delivery tube 34. A check valve 32 is preferably fluidly positioned within the main delivery tube 34 for preventing airflow from reversing and entering the air pump 30 when the air pump 30 is terminated.

As shown in FIGS. 4 and 5 of the drawings, a first cycle timer 42 is positioned within the housing 20 and is electrically connected between the power switch 22 and the first valve 50. The first cycle timer 42 is adjustable by the user and determines the period of time that the first valve 50 is open. The first valve 50 is positioned within the housing 20 as shown in FIG. 4 of the drawings.

Figure 2:
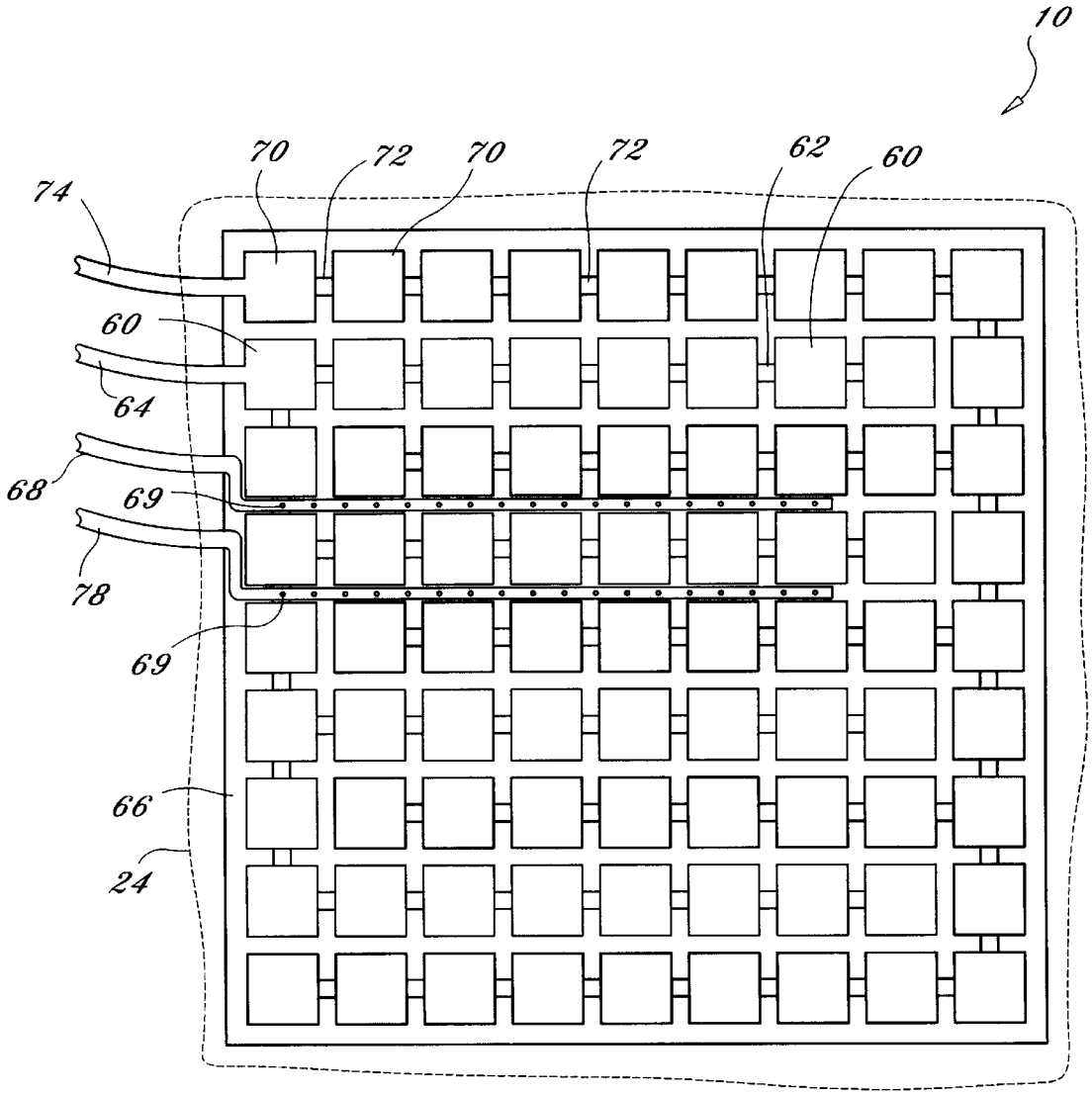
FIG. 2 is a top view of the present invention.

The first valve 50 includes a first discharge port 52 that is closed when the first valve 50 is open. The first discharge port 52 opens when the first valve 50 is closed. As shown in FIG. 4 of the drawings, a first delivery tube 64 is fluidly connected to the first valve 50 opposite of the main delivery tube 34. The first delivery tube 64 is fluidly connected to the plurality of first pockets 60 as shown in FIG. 2 of the drawings.

As shown in FIGS. 4 and 5 of the drawings, a second cycle timer 44 is positioned within the housing 20 and is electrically connected between the power switch 22 and the second valve 54. The second cycle timer 44 is adjustable by the user and determines the period of time that the second valve 54 is open. The second valve 54 is positioned within the housing 20 as shown in FIG. 4 of the drawings.

The second valve 54 includes a second discharge port 56 that is closed when the second valve 54 is open. The second discharge port 56 opens when the second valve 54 is closed. As shown in FIG. 4 of the drawings, a second delivery tube 74 is fluidly connected to the second valve 54 opposite of the main delivery tube 34. The second delivery tube 74 is fluidly connected to the plurality of second pockets 70 as shown in FIG. 3 of the drawings.

Figure 3:
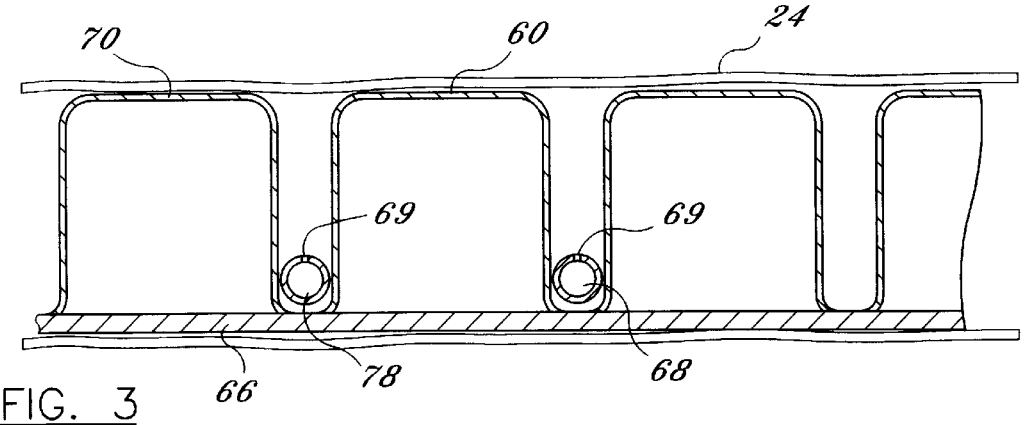
FIG. 3 is a side cutaway view of the cushion.

As shown in FIGS. 3 of the drawings, a plurality of first pockets 60 and a plurality of second pockets 70 are secured to a base 66. The pockets 60, 70 are preferably constructed of a resilient material such as, but not limited to, rubber or neoprene for allowing the pockets 60, 70 to be repeatedly inflated and deflated over periods of time.

As shown in FIGS. 1 and 2 of the drawings, a removable covering 24 is preferably positionable over the pockets 60, 70. The covering 24 preferably is permeable allowing air to flow from first return tube 68 and the second return tube 78 through the covering 24 to adequately ventilate the areas of contact between the individual's body and the cushion system 10. The covering 24 is preferably constructed of a cloth material, however a perforated material may also be utilized for the covering 24.

The plurality of first pockets 60 are secured to the base 66 by conventional means. The plurality of first pockets 60 are fluidly connected to one another by a plurality of first connecting tubes 62 as shown in FIGS. 1 and 2 of the drawings. The first pockets 60 preferably have a rectangular shape, however it can be appreciated that the first pockets 60 may have any well-known shape and structure.

The plurality of second pockets 70 are secured to the base 66 by conventional means. The plurality of second pockets 70 are fluidly connected to one another by a plurality of second connecting tubes 72 as shown in FIGS. 1 and 2 of the drawings. The second pockets 70 preferably have a rectangular shape, however it can be appreciated that the second pockets 70 may have any well-known shape and structure.

As best shown in FIG. 2 of the drawings, the first pockets 60 form an inverted L-shape surrounding two adjacent sides of the base 66. The second pockets 70 form an L-shape surrounding the remaining two adjacent sides of the base 66 as further shown in FIG. 2 of the drawings. Rows of the first pockets 60 and the second pockets 70 extend toward the center portion of the base 66 as shown in FIG. 2. The rows of first pockets 60 and second pockets 70 preferably are staggered for providing the maximum effectiveness in supporting the individual.

As shown in FIG. 4 of the drawings, a first return tube 68 is fluidly connected to the first discharge port 52 of the first valve 50. The first return tube 68 extends between the pockets 60, 70 as shown in FIGS. 1 and 2 of the drawings. The first return tube 68 includes a plurality of apertures 69 within that disperse the air received from the first discharge port 52 when the first valve 50 closes thereby releasing the air pressure within the first delivery tube 64. The first return tube 68 may extend between the pockets 60, 70 in any configuration desired to achieve the desired ventilation between the pockets 60, 70 and the covering 24.

As shown in FIG. 4 of the drawings, a second return tube 78 is fluidly connected to the second discharge port 52 of the second valve 50. The second return tube 78 extends between the pockets 60, 70 as shown in FIGS. 1 and 2 of the drawings. The second return tube 78 includes a plurality of apertures 69 within that disperse the air received from the second discharge port 56 when the second valve 54 closes thereby releasing the air pressure within the second delivery tube 74. The second return tube 78 may extend between the pockets 60, 70 in any configuration desired to achieve the desired ventilation between the pockets 60, 70 and the covering 24.

As shown in FIG. 4 of the drawings, a pressure switch 46 is connected to the main delivery tube 34 for detecting the pressure within the main delivery tube 34. A buzzer 48 is electrically connected to the pressure switch as further shown in FIG. 4 of drawings. If the pressure within the main delivery tube 34 falls below a desired level for a period of time, the pressure switch 46 activates the buzzer 48 which emits an audible warning sound that warns the user that the pressure within the pockets 60, 70 has dropped below a desired level.

In use, the user adjusts the pump timer 40 to the desired amount of time depending upon the weight of the user. The heavier the individual is, generally the longer period of time the pump timer 40 will be set for. The user then adjusts the first cycle timer 42 and the second cycle timer 44 to the desired periods of time. The user positions the base 66 upon the seat of the wheelchair 12 and connects the housing 20 to the wheelchair 12 with the straps. The user then closes the power switch 22 thereby providing electrical power to the pump timer 40 and the first cycle timer 42. The air pump 30 operates for the period of time (P1)) specified by the pump timer 40 while the first cycle timer 42 opens the first valve 50 for the period of time (T1)) specified by the first cycle timer 42 thereby allowing air to enter the first pockets 60 thereby inflating and pressurizing the first pockets 60. When the time period P1 expires and terminates operation of the air pump 30, the check valve 32 prevents air from being released back into the air pump 30 from the first pockets 60. Typically P1 will be a shorter period of time T1, however it can be appreciated that various combinations can be achieved. During the time the first valve 50 is open, the second valve 54 is closed.

When the period of time T1 expires, the first valve 50 is closed thereby opening the first discharge port 52 thereby allowing the air pressure within the first pockets 60 to be released through the first discharge port 52 into the first return tube 68 where it is dispensed through the apertures 69 to dry and cool the individual's body in contact with the cushion. The air pump 30 then operates again for the period of time (P1) specified by the pump timer 40 while the second cycle timer 44 opens the first valve 50 for the period of time (T2) specified by the second cycle timer 44 thereby allowing air to enter the second pockets 70 thereby inflating and pressurizing the second pockets 70. When the time period P1 expires and terminates operation of the air pump 30, the check valve 32 prevents air from being released back into the air pump 30 from the second pockets 70. During the time the second valve 54 is open, the first valve 50 is closed. When the period of time T2 expires, the second valve 54 is closed thereby opening the second discharge port 56 thereby allowing the air pressure within the second pockets 70 to be released through the second discharge port 56 into the second return tube 78 where it is dispensed through the apertures 69 to dry and cool the individual's body in contact with the cushion. The above process is repeated until the user opens the power switch 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wheelchair cushion system, comprising:

a base formed to fit within a seat of a wheelchair;

a plurality of first pockets attached to said base and fluidly connected to one another;

a plurality of second pockets attached to said base and fluidly connected to one another; and a control means fluidly connected to said plurality of first pockets and said plurality of said second pockets, wherein said control means provides pressurized air selectively to said first pockets and said second pockets in alternating intervals;

wherein said control means comprises:

a housing;

a power source within said housing;

a power switch electrically connected to said power source;

a first cycle timer electrically connected to said power switch, wherein said first cycle timer controls interval T1;

a second cycle timer electrically connected to said power switch, wherein said second cycle timer controls interval T2; and an air pressure means within said housing for controlling air pressure within said first pockets and said second pockets;

wherein said air pressure means comprises:

a pump timer electrically connected to said power switch;

an air pump electrically connected to said pump timer, wherein said pump timer controls power to said air pump for an interval P1 period of time;

a first valve fluidly connected to said air pump and fluidly connected to said first pockets, wherein said first valve includes a first discharge port for allowing air pressure within said first pockets to escape when said first valve is closed;

a first return tube fluidly connected to said first discharge port and positioned between said pockets for delivering the exhaust air through a plurality of apertures within said first return tube;

a second valve fluidly connected to said air pump and fluidly connected to said second pockets, wherein said second valve includes a second discharge port for allowing air pressure within said second pockets to escape when said second valve is closed; and a second return tube fluidly connected to said second discharge port and positioned between said pockets for delivering the exhaust air through a plurality of apertures within said second return tube .

2. The wheelchair cushion system of claim 1, wherein said plurality of first pockets are inflated at said interval T1 and said plurality of second pockets are inflated at said interval T2.

3. The wheelchair cushion system of claim 1, wherein said plurality of first pockets are relatively aligned in rows with respect to said plurality of second pockets.

4. The wheelchair cushion system of claim 1, wherein intervals T1 and T2 can be adjusted by a user.

5. The wheelchair cushion system of claim 1, wherein said air pump includes a check valve between said air pump and said first valve and said second valve for preventing air flow back through said pump.

6. The wheelchair cushion system of claim 1, wherein said interval P1 is adjustable depending upon the desired air pressure within said first pockets and said second pockets.

7. The wheelchair cushion system of claim 1, wherein said power source is rechargeable.

8. The wheelchair cushion system of claim 1, wherein said housing is attachable to said wheelchair by a plurality of straps.

9. A wheelchair cushion system, comprising:

a plurality of first pockets fluidly connected to one another;

a plurality of second pockets fluidly connected to one another, wherein said plurality of first pockets and said plurality of second pockets are positionable upon a seat of a wheelchair;

a control means fluidly connected to said plurality of first pockets and said plurality of second pockets, wherein said control means provides pressurized air selectively to said first pockets and said second pockets in alternating intervals;

a means for providing increased air ventilation between said pockets; and a covering surrounding said pockets, wherein said covering is permeable;

wherein said control means comprises:

a housing;

a power source within said housing;

a power switch electrically connected to said power source;

a first cycle timer electrically connected to said power switch, wherein said first cycle timer controls interval T1;

a second cycle timer electrically connected to said power switch, wherein said second cycle timer controls interval T2; and an air pressure means within said housing for controlling air pressure within said first pockets and said second pockets;

wherein said air pressure means comprises:

a pump timer electrically connected to said power switch;

an air pump electrically connected to said pump timer, wherein said pump timer controls power to said air pump for an interval P1 period of time;

a first valve fluidly connected to said air pump and fluidly connected to said first pockets, wherein said first valve includes a first discharge port for allowing air pressure within said first pockets to escape when said first valve is closed;

a first return tube fluidly connected to said first discharge port and positioned between said pockets for delivering the exhaust air through a plurality of apertures within said first return tube;

a second valve fluidly connected to said air pump and fluidly connected to said second pockets, wherein said second valve includes a second discharge port for allowing air pressure within said second pockets to escape when said second valve is closed; and a second return tube fluidly connected to said second discharge port and positioned between said pockets for delivering the exhaust air through a plurality of apertures within said second return tube.

10. The wheelchair cushion system of claim 9, wherein said plurality of first pockets are inflated at said interval T1 and said plurality of second pockets are inflated at said interval T2.

11. The wheelchair cushion system of claim 9, wherein said plurality of first pockets are relatively aligned in rows with respect to said plurality of second pockets.

12. The wheelchair cushion system of claim 9, wherein said intervals T1 and T2 can be adjusted by a user.

13. The wheelchair cushion system of claim 9, wherein said means for providing increased air ventilation is comprised of:

a first return tube fluidly connected to said first discharge port and positioned between said pockets for delivering the exhaust air through a plurality of apertures within said first return tube; and a second return tube fluidly connected to said second discharge port and positioned between said pockets for delivering the exhaust air through a plurality of apertures within said second return tube.

14. The wheelchair cushion system of claim 9, wherein said interval P1 is adjustable depending upon the desired air pressure within said first pockets and said second pockets.

15. The wheelchair cushion system of claim 9, wherein said power source is rechargeable.

16. A wheelchair cushion system, comprising:

a plurality of pockets fluidly connected to one another, wherein said plurality of pockets are positionable upon a seat of a wheelchair;

a pump timer;

an air pump electrically connected to said pump timer, wherein said pump timer controls power to said air pump for an interval P1 period of time;

at least one valve fluidly connected to said air pump and fluidly connected to said pockets, wherein said valve includes at least one discharge port for allowing air pressure within said pockets to escape when said valve is closed;

at least one return tube fluidly connected to said discharge port and positioned between said pockets for delivering exhaust air from said pockets through a plurality of apertures within said return tube; and a covering surrounding said pockets, wherein said covering is permeable for allowing ventilation.

* * * * *